US007748580B2

(12) United States Patent
Berthelin et al.

(10) Patent No.: US 7,748,580 B2
(45) Date of Patent: Jul. 6, 2010

(54) FLUID PRODUCT DISPENSING HEAD

(75) Inventors: Frédéric Berthelin, Meaux (FR); Erwan Delisle, Groissat (FR); Luc Uytterhaeghe, Varredes (FR); Alain Huet, Noisy le Grand (FR); Serge Lebalc'h, Penchard (FR); Chi-Hung Vo, Meaux (FR)

(73) Assignee: Seaquist General Plastics, Poincy (FR)

( * ) Notice: Subject to any disclaimer, the term of this patent is extended or adjusted under 35 U.S.C. 154(b) by 1050 days.

(21) Appl. No.: 10/564,163

(22) PCT Filed: Jul. 13, 2004

(86) PCT No.: PCT/FR2004/001845

§ 371 (c)(1),
(2), (4) Date: Jun. 21, 2006

(87) PCT Pub. No.: WO2005/007534

PCT Pub. Date: Jan. 27, 2005

(65) Prior Publication Data

US 2007/0017937 A1 Jan. 25, 2007

(30) Foreign Application Priority Data

Jul. 15, 2003 (FR) ..... 03 08626

(51) Int. Cl.
*B67D 3/00* (2006.01)

(52) U.S. Cl. ..... 222/521; 222/519

(58) Field of Classification Search ..... 222/502, 222/505, 521, 520, 153.07, 549, 524, 525, 222/48, 519, 531, 537, 523; 215/313, 314
See application file for complete search history.

(56) References Cited

U.S. PATENT DOCUMENTS

| | | | | | |
|---|---|---|---|---|---|
| 2,533,915 | A * | 12/1950 | Brooks | 222/513 |
| 3,231,155 | A * | 1/1966 | McConnell | 222/482 |
| 3,430,798 | A * | 3/1969 | Goyet et al. | 215/295 |
| 4,424,918 | A * | 1/1984 | Stull | 222/153.14 |
| 4,779,764 | A * | 10/1988 | Debetencourt | 222/83 |
| 4,823,994 | A * | 4/1989 | Laauwe | 222/521 |
| 4,842,169 | A * | 6/1989 | Stull | 222/521 |
| 5,000,360 | A | 3/1991 | Lown et al. | |
| 5,429,282 | A * | 7/1995 | Stebick | 222/521 |
| 6,135,318 | A * | 10/2000 | Valley | 222/48 |
| 6,394,295 | B2 * | 5/2002 | Claude | 215/318 |
| 6,675,995 | B2 * | 1/2004 | Stull et al. | 222/520 |
| 2001/0042730 | A1 | 11/2001 | Claude | |
| 2003/0094430 | A1 | 5/2003 | Stull et al. | |

* cited by examiner

*Primary Examiner*—Kevin P Shaver
*Assistant Examiner*—Robert K Nichols, II
(74) *Attorney, Agent, or Firm*—Sughrue Mion, PLLC

(57) ABSTRACT

A fluid dispenser head for associating with a fluid reservoir (1), the head having: a stationary base (2) formed by, or for mounting on, the reservoir; a rotary actuator element (3) mounted in rotary manner on the base (2) so as to turn about an axis of rotation between two extreme abutment positions; and a dispenser orifice (30) that can be closed selectively by turning the element on the base. The two extreme abutment positions define two open positions of the dispenser orifice separated by at least one position in which the dispenser orifice is closed. The dispenser orifice (30) is situated on the axis of rotation of the element on the base.

20 Claims, 5 Drawing Sheets

FLUID PRODUCT DISPENSING HEAD

The present invention relates to a fluid dispenser head for associating with a fluid reservoir. The dispenser head generally comprises a stationary base formed by, or mounted on, the reservoir. In addition, the head comprises a rotary actuator element mounted in rotary manner on the base so as to turn about an axis between two extreme abutment positions. In addition, the head comprises a dispenser orifice that can be closed selectively by turning the actuator element on the base. Such a dispenser head is frequently used as an actuatable closure system for dispensing fluid in the form of a liquid, grains, or a powder stored in a reservoir. An advantageous application for such a head exists in the fields of the food industry, skin care, or even cosmetics. However, other fields are not excluded.

In general, such a dispenser head having a base and a rotary actuator element is actuatable between an open position and a closed position by turning the actuator element on the base. It is also known that turning the rotary element on the base makes it possible to uncover or to open one or more dispenser orifices that are closed in the closed position. Heads are also known that are provided with a plurality of dispenser orifices of different sections, so as to be able to vary the rate at which the fluid flows through the dispenser orifices. However, the present invention relates to a type of dispenser head having a single dispenser orifice, although the orifice can itself have a plurality of holes. With such a dispenser head having a single dispenser orifice, turning the actuator element makes it possible merely to close or to open the dispenser orifice between the two extreme abutment positions.

An object of the present invention is to define a dispenser head having a single dispenser orifice, that enables the dispenser orifice to be used in modular manner. Another object of the invention is to make it possible to open the dispenser orifice in graduated manner.

In order to achieve these objects, the present invention proposes that, while the actuator element is being turned on the base, the two extreme abutment positions define two open positions of the dispenser orifice separated by at least one intermediate closed position in which the dispenser orifice is closed. Thus, merely by turning the actuator element on the base in the clockwise direction and in the anticlockwise direction, two open positions are achieved, advantageously disposed symmetrically about the closed position. The two open positions may impart identical fluid flow characteristics, such that the two positions are completely symmetrical and equivalent. However, in the invention, the dispenser head further comprises flowrate-varying means making it possible to vary, from one open position to the other, the rate at which the fluid flows through the dispenser orifice. Consequently, over a given length of time, one open position makes it possible to dispense more fluid than the other open position. In this way, fluid is dispensed in modular manner through the dispenser orifice.

In an advantageous embodiment, the dispenser orifice is situated on the axis of rotation of the element on the base. The packaging or the dispenser fitted with the dispenser head of the invention is thus in the form of a conventional salt or pepper pot with a single axial central dispenser orifice.

According to another advantageous characteristic of the invention, the dispenser head further comprises axial displacement means that are capable of axially displacing the element relative to the base while it is turning on the base.

The axial displacement means advantageously comprise at least one guide path presenting two different sections that are connected together at a low point, each of the two sections defining a respective extreme abutment, the two extreme abutments respectively corresponding to the two open positions, and the low point corresponding to the closed position. The base preferably forms at least one axial, rotary guide window that extends over a fraction of the periphery of the base, said window defining a guide path, said window forming two connected-together window sections, a first section defining a first slope, and the second section defining a second slope that is different from the first slope, each section defining an abutment end, the abutment ends being offset axially, the actuator element including at least one axial, rotary guide lug engaged in said window, so that while the actuator element is being turned on the base, said at least one lug is displaced in its respective window, thereby displacing the actuator element axially, so as to reach different heights depending on whether the lug is in abutment against the first section or against the second section. And in order to vary the flowrate, the slopes may present inclinations and/or lengths that are different. In a practical embodiment, the base includes a ring formed with a plurality of axial, rotary guide windows distributed over the periphery of the ring, the cover including a skirt that extends around the ring, and that, on its inside, forms a plurality of axial, rotary guide lugs that are engaged in respective windows.

In another aspect of the invention, the element forms the dispenser orifice, and the base forms a closure pin, which, in the closed position, is engaged in the dispenser orifice, and in the open positions, is disengaged from the orifice by different amounts, so that the flowrates through the orifice are different in the two open positions. It is the greater or lesser disengagement of the pin from the dispenser opening that makes it possible to vary the flowrate from one open position to the other. More precisely, this greater or lesser disengagement makes it possible to vary the flow section of the fluid immediately downstream from the single dispenser orifice. The actuator element advantageously includes axial guide means engaged around the pin, so that the pin is slidably mounted in said axial guide means, said guide means extending downwards from the periphery of the dispenser orifice, said guide means forming a plurality of slots of sizes that vary as a function of the position of the pin in the axial guide means. In a practical embodiment, the axial guide means comprise a plurality of tabs that extend downwards from the outer periphery of the dispenser orifice, said tabs being connected together by a scraper that is slidably engaged around the pin. The base may include an inner sleeve inside which the pin extends, the actuator element includes a cover disposed on the sleeve and forming the dispenser orifice, said cover including an annular lip in leaktight, rotary sliding contact with said sleeve. According to another characteristic of the invention, the actuator element includes a detachable safety tab that is blocked by the base, so that, in the closed position, the actuator element is prevented from turning on the base.

Thus, by turning the actuator element on the base to one side and to the other from the intermediate closed position, two open positions are achieved in which the axial height of the actuator element is different. This results from the fact that one extreme abutment is situated axially higher than the other. This has a direct affect on the disengagement height of the pin inside the dispenser orifice, thereby making it possible to vary the flowrate.

The invention is described more fully below with reference to the accompanying drawings which show an embodiment of the invention by way of non-limiting example.

Figure 1:
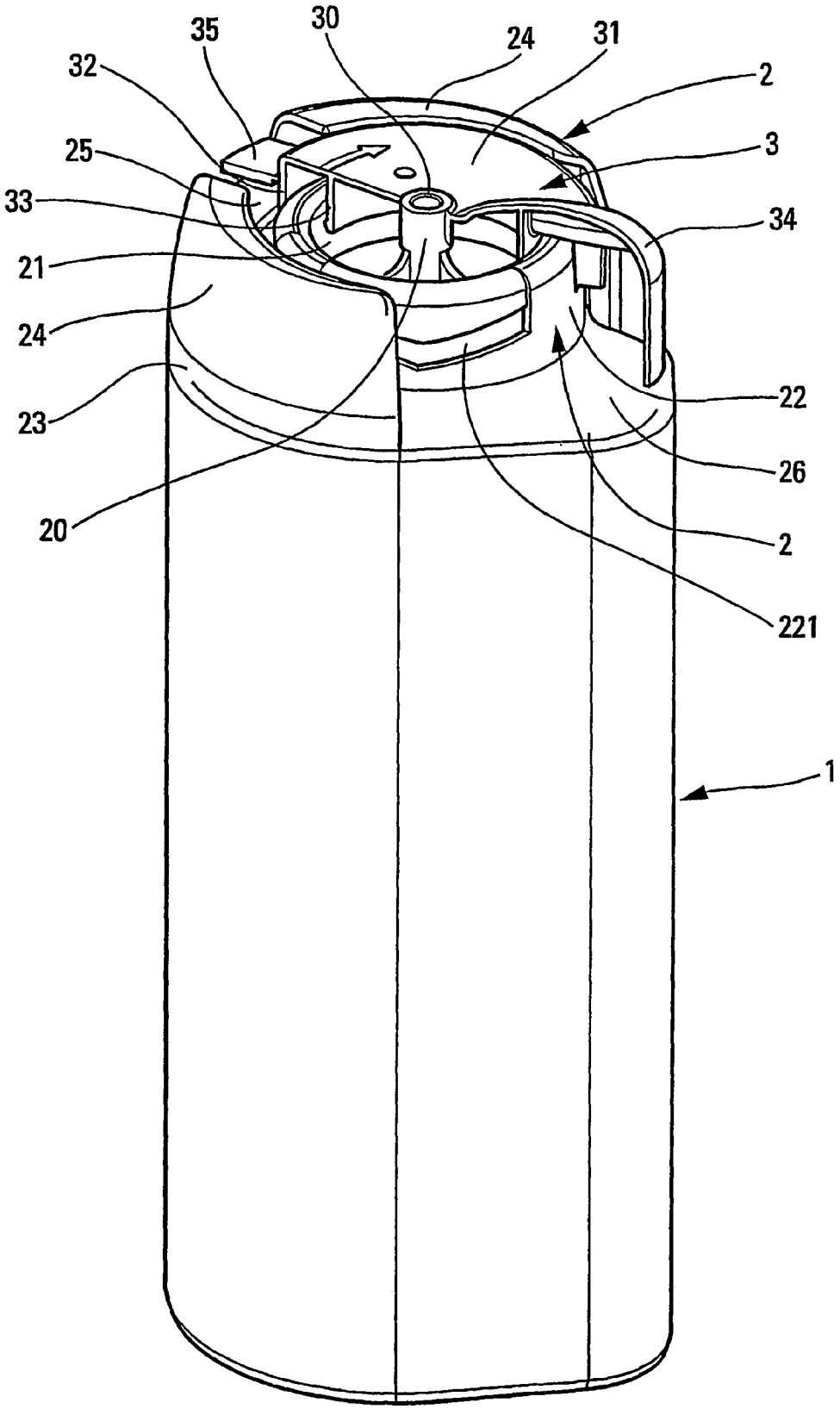
FIG. 1 is a partially cut-away perspective view of a fluid dispenser fitted with a dispenser head of the invention.

The fluid dispenser fitted with the dispenser head of the invention includes a reservoir 1 for containing the fluid, e.g. salt, cream, or shampoo. More generally, the fluid can be a liquid, grains, or a powder. At its top end, the reservoir 1 forms a snap-fastener groove 11, and a shoulder 12 that extends radially inwards and that is terminated by a neck 13. The neck 13 defines an opening enabling fluid that is stored in the reservoir to be removed therefrom. The reservoir is not a critical component of the present invention: it can be of any shape and size. Even the snap-fastener groove 11 together with the shoulder 12 and the neck 13 can present a different configuration, without thereby going beyond the ambit of the present invention.

In this embodiment, the reservoir 1 is associated with a dispenser head comprising two component elements, namely a base 2, and a rotary actuator element 3. In this embodiment, the base 2 is mounted on the reservoir 1, but it is also possible to envisage that the base 2 is made integrally as a single part with the reservoir 1. Although, in this embodiment, the dispenser head comprises two component elements, the dispenser head might comprise even more component elements in certain embodiments that do not go beyond the ambit of the invention. However, from a molding and assembly point of view, an embodiment having two component elements is advantageous.

With reference to any of the figures, it can be seen that the base 2 includes an inner sleeve 21 defining a bottom end portion 211 that is in leaktight contact with the inside of the neck 13. The leaktight contact is a static leaktight contact, given that the base 2 is designed to be mounted in stationary manner on the reservoir 1. The sleeve 21 defines an internal passage that is in direct communication with the inside of the reservoir 1, given that the sleeve is disposed inside the neck 13. A pin 20 defining an external top end 201 is disposed centrally and axially inside the sleeve 21. Holding ribs 202 connect the inside wall of the sleeve 21 to the pin 20. From its top end 201, the pin 20 preferably presents a cylindrical outer wall. At its top end, the sleeve 21 is connected to a ring 22 that extends coaxially around the sleeve 21. As can be seen in some figures, and in particular in FIG. 2, the ring 22 is provided with a plurality of windows 221 that form openings in the wall of the ring 22. Each of the windows 221, which in this embodiment are three in number, forms a guide path. The windows are distributed at uniform angular spacing around the periphery of the ring 22. Each window 221 is substantially in the form of a chevron with its point directed downwards. Each window 221 thus defines a first window section 2211 and a second window section 2212. Each section is in the form of a slope or ramp that is substantially rectilinear, but that is inclined relative to the horizontal or to the vertical. Each section thus presents a slope 2215, 2216 having a certain length, a certain profile, and a certain degree of inclination. The degrees of inclination of the two slopes can be identical, but, in the invention, the degrees of inclination of the two slopes are preferably different. The first section 2211 presents a slope having a degree of inclination that is less than the degree of inclination of the slope of the second window section. In addition, the window sections 2211 and 2212 are connected together at a low point 2210. At its opposite end, each window section includes an abutment end 2213, 2214 that defines the extreme limit of the window section. In this embodiment, the abutment ends 2213 and 2214 are at an equal distance from the low point 2210, so that each window section presents an identical length. Given that the degrees of inclination of the slopes of the window sections are different, and that their lengths are identical, the abutment ends 2213 and 2214 are not situated in a common plane, but are, on the contrary, axially offset. Given that the degree of inclination of the slope of the second section is greater than the degree of inclination of the slope of the first section 2211, the abutment end 2214 is therefore situated axially higher than the abutment end 2213. The axial offset of the abutment ends of the two window sections can also be obtained with slopes having identical degrees of inclination, but different lengths. By providing a window section 2212 that is longer than the window section 2211, but with identical degrees of inclination, the abutment end 2214 is also axially offset upwards relative to the abutment end 2213. Consequently, the axial offset of the abutment ends of the windows 221 can be obtained by varying either the degree of inclination of the slopes of the window sections, or the lengths of the slopes of the window sections. It is also possible to envisage a combination of different lengths and different degrees of inclination. However, in the invention, it is possible for the abutment ends of the windows to be disposed in a common plane. However, it is preferable to offset the ends.

Figure 2:
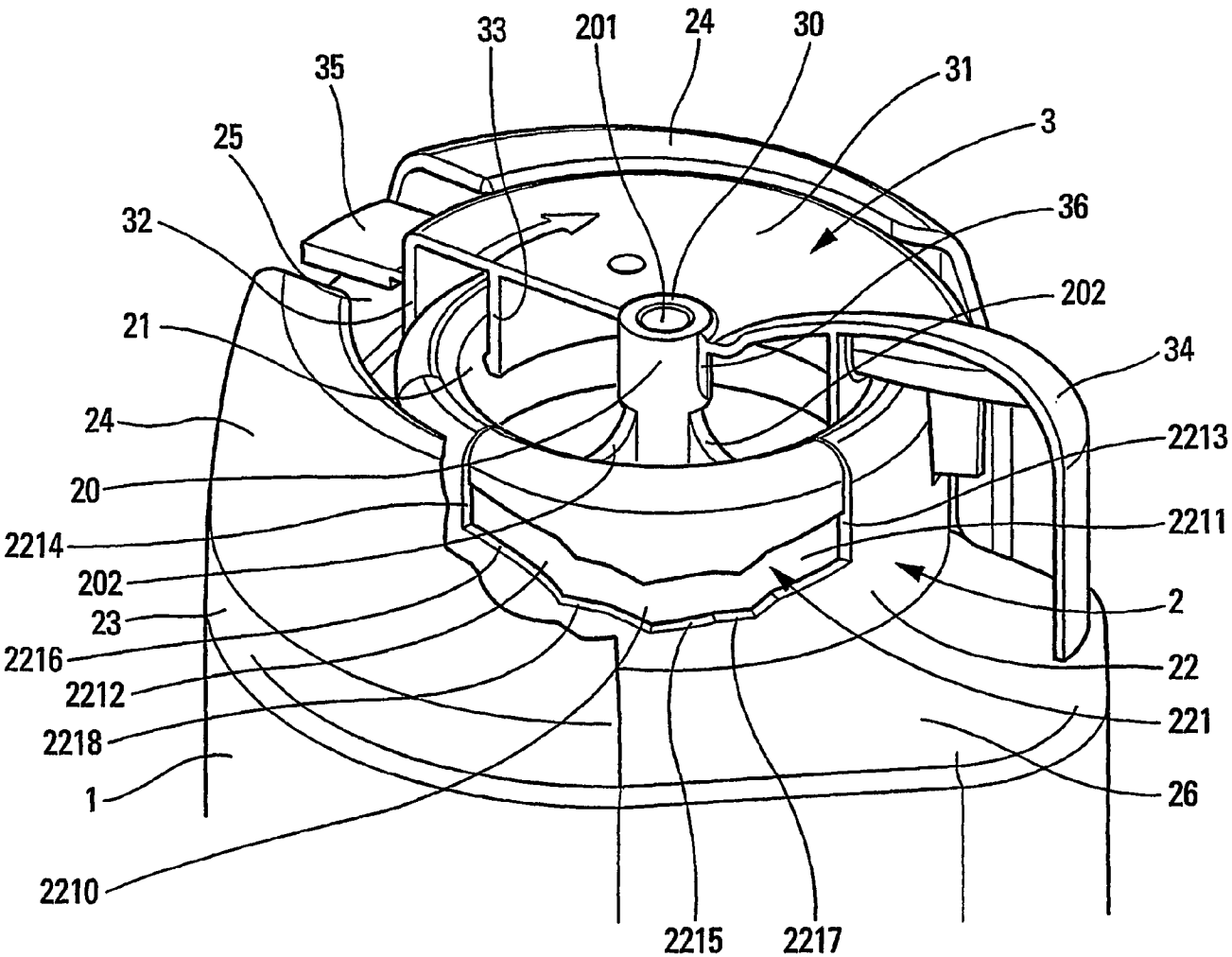
FIG. 2 is a larger-scale view of the FIG. 1 dispenser head.

With reference to FIG. 2, it should also be observed that each of the slopes 2215 and 2216 forms a setback 2217 or 2218 that interrupts the linearity of the slope. The setbacks, notches, or steps define intermediate positions between the low point 2210 and the abutment ends 2213 and 2214.

Around the ring 22, the base 2 forms a complex configuration that is not uniform around the periphery of the ring. Specifically, the base forms two flanges 24 that are interrupted firstly by a lower indentation 25, and secondly by a shelf 26. The indentation 25 is situated below the flanges 24, and the shelf 26 is also situated below the flanges 24, at a height that is even lower than the height of the indentation 25. It should be observed that the indentation 25 is situated substantially diametrally opposite the shelf 26. The indentation 25 extends over an angle lying in the range about 10° to 30°, whereas the shelf 26 extends over an angle that is greater than 90°. At its bottom outer periphery, the base also forms a fastener collar 23 that is fastened by snap-fastening and that is for co-operating with the snap-fastener groove 11 formed by the reservoir 1. The base 2 is thus mounted in stationary manner on the reservoir 1 at the groove 11, and this in leaktight manner by means of the bottom end portion 211 of the sleeve 21 being engaged in leaktight manner in the neck 13.

Figure 3:
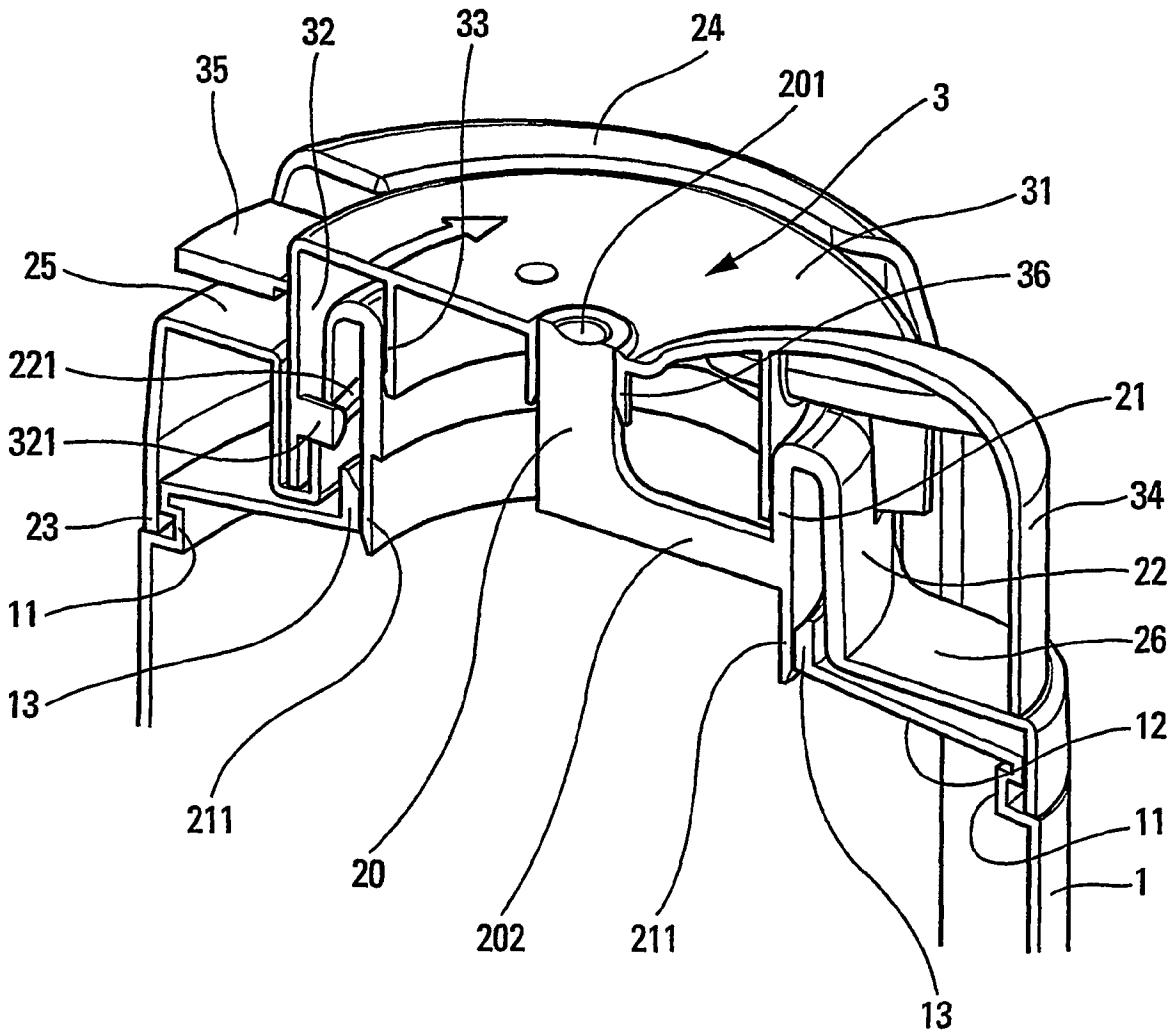
FIG. 3 is a perspective view in vertical section showing the dispenser head of the preceding figures in the closed position.

In this embodiment, the rotary actuator element 3 is in the form of a cover comprising a rotary closure plate 31 that is pierced centrally by a dispenser orifice 30. In FIGS. 1, 2, and 3, the pin 20 is engaged in substantially leaktight manner in the dispenser orifice 30. On the bottom periphery of the dispenser orifice 30, the plate 31 forms an axial guide tower 36 that extends around the pin 20 over a certain height. In this embodiment, the tower 36 is constituted by a plurality of tabs interconnecting the periphery of the dispenser orifice 30 and a scraper 362. The tower thus defines a plurality of flow slots 363 between the tabs 361. This can be seen in FIG. 4, in which the top end 201 of the pin 20 is downwardly offset relative to the plate 31, thereby opening the slots 363. It will easily be understood that the slots 363 form a communication passage between the internal space formed by the sleeve 21 in direct communication with the reservoir, and the outside of the head. Thus, the fluid stored in the reservoir 1 can flow through the dispenser orifice 30 by passing through the flow slots 363 when the pin 20 is withdrawn into the head. The guide and scraper tower 36 makes it possible not only to hold the pin 20 in the axis of rotation of the head, but also makes it possible, each time the actuator element is turned, to clean the pin 20 by means of a scraping effect obtained by displacing the pin in the tower. The scraper 362 and the tabs 361 participate in this scraping action.

Figure 4:
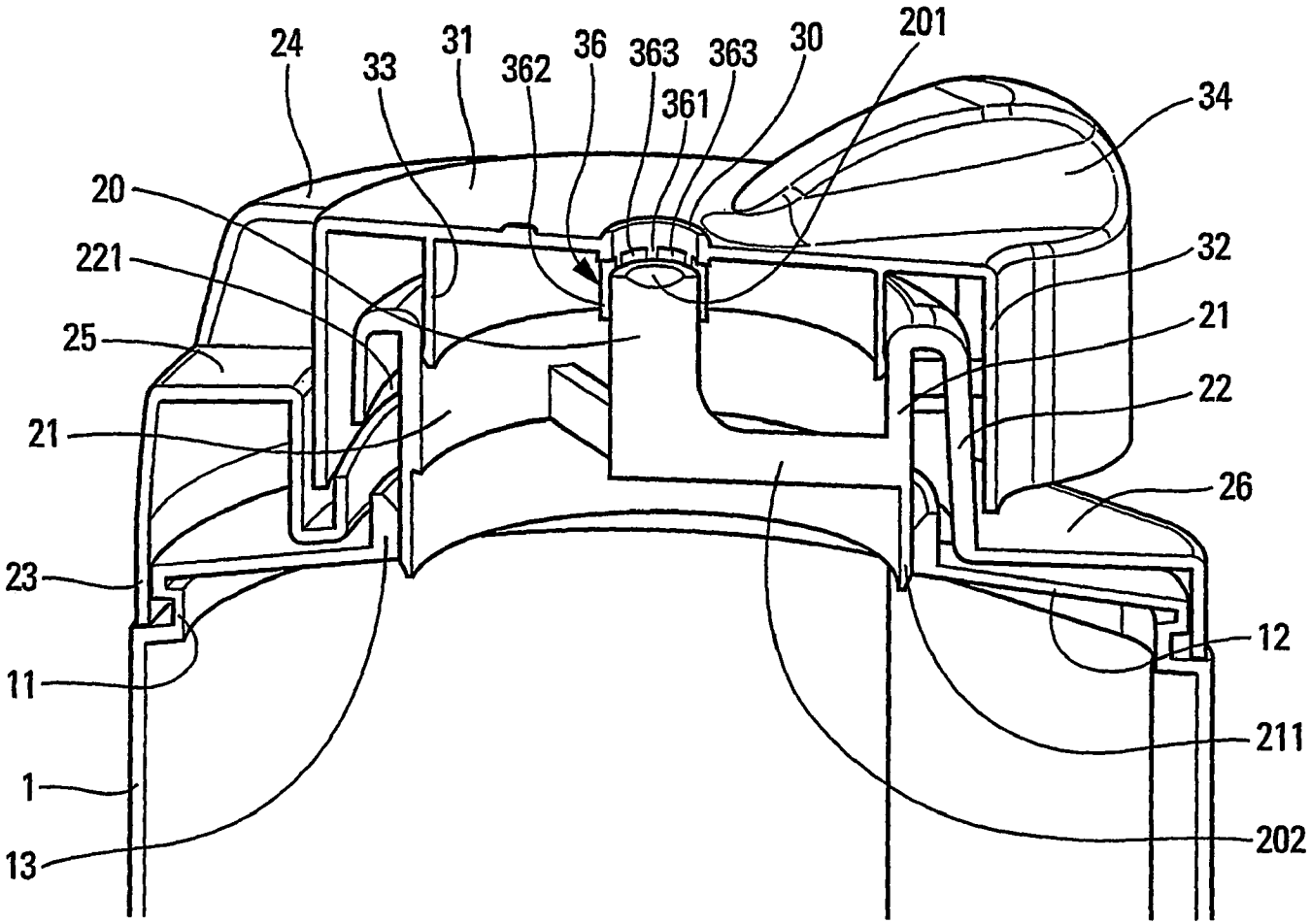
FIG. 4 is a view similar to the view in FIG. 3, in one open position.
Figure 5:
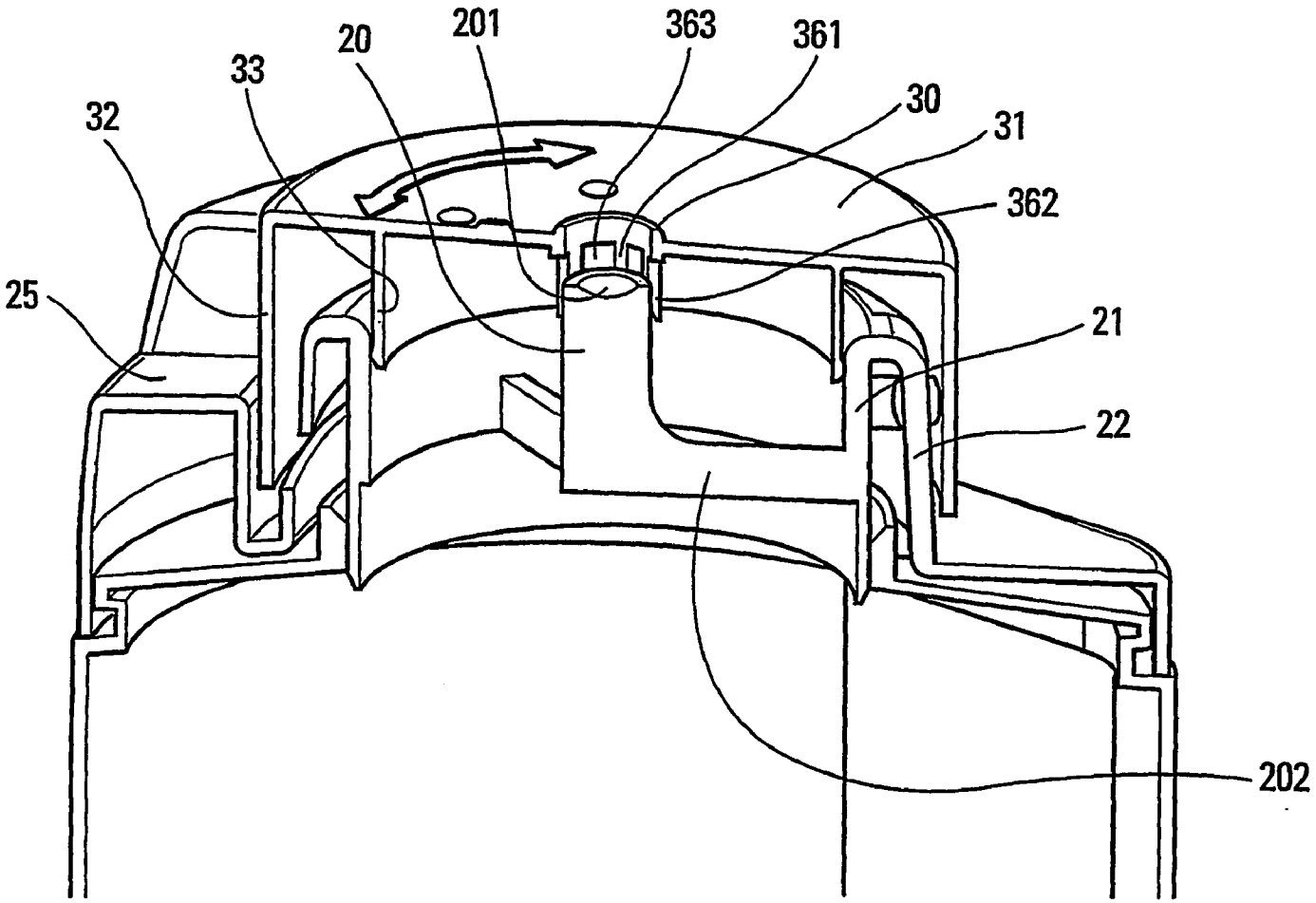
FIG. 5 is a view similar to the view in FIG. 4, in the other open position.

At its outer periphery, the plate 31 is extended downwards by a skirt 32. The skirt 32 is disposed in concentric manner about the ring 22. In this embodiment, the skirt 32 forms three lugs 321 that are engaged in respective windows 221 formed by the ring 22. This can be seen in FIG. 3, for one lug and one window. However, it is possible to envisage that the skirt 32 includes three lugs 321 that are distributed uniformly at 120° intervals around the periphery of the inside wall of the skirt 32. Given that each lug 321 is engaged in a respective window 221, and that the window presents a profile having two identical or different slopes, turning the rotary actuator element 3 on the base 2 causes the lugs to be displaced in the windows following the profile of the slopes. When the lugs 321 are situated at the low points 2210 of the windows 221, the rotary actuator element 3 is at its lowest level relative to the base 2. The pin 20 is thus situated at its highest level in the guide and scraper tower 36. This corresponds to the closed position of the dispenser head, as shown in FIGS. 1, 2, and 3, in which the top end 201 of the pin 20 is situated in the dispenser orifice 30, advantageously in leaktight manner. It should also be observed that the top end 201 is situated substantially in the same plane as the plate 31. By turning the rotary actuator element 3 on the base 2 in either the clockwise direction or the anticlockwise direction, the lugs are displaced in one of the two window sections formed by each window. The lugs thus follow the slopes of the guide paths defined by each window section. The rotary actuator element 3 can thus be turned until the lugs come into abutment against the abutment ends 2213 or the abutment ends 2214, depending on whether the element 3 is turned in the clockwise direction or in the anticlockwise direction. In both events, the lug is constrained to move axially upwards as a result of the chevron configuration of the windows 2211 with their points directed downwards. This causes the plate 31, and consequently the dispenser orifice 30, to rise, while the pin 20 remains stationary. Visually, the pin 20 is driven into the tower 336, thereby opening the slots 363. When the lugs come into abutment against the abutment ends, the dispenser head has thus reached one of the open positions. Naturally, another open position can be reached when the lugs are in abutment against the other abutment ends of the windows. Consequently, there are two extreme open positions that correspond to two driven-in positions of the pin 20 in the tower 36. It is also possible to speak of disengaging the pin 20 from the dispenser orifice 30. When the abutment ends 2213 and 2214 are situated in a common horizontal plane, i.e. when there is no axial offset between the abutment ends, the pin is driven-in or disengaged in the same way, and to the same extent, in both open positions. In contrast, when the abutment ends 2213 and 2214 are axially offset, as in the preferred embodiment of the invention, the two open positions correspond to two different engagement or driven-in positions of the pin 20 relative to the dispenser orifice 30. This can be seen by comparing FIGS. 4 and 5, which show the dispenser head in the two different open positions. It can easily be seen that the slots 363 in FIG. 4 are smaller than the slots in FIG. 5. This is explained by the fact that, in FIG. 5, the pin 20 is driven further into the tower 36 than in FIG. 4. As a result, the rate at which the fluid flows through the single dispenser orifice 30 is faster in the open position corresponding to FIG. 5 than in the open position in FIG. 4.

The setbacks 2217 and 2218 formed by the slopes 2215 and 2216 advantageously define stable, intermediate open positions corresponding to a fixed, intermediate flowrate. Thus, with a single window, it is possible to define two extreme open positions separated by a plurality of fixed, intermediate open positions and at least one fixed, intermediate closed position. It is possible to provide a plurality of closed positions and more than two intermediate open positions, or alternatively, a single intermediate open position on one of the two slopes.

Driving the pin 20 to a greater or less extent into the tower 36, and respectively into the dispenser orifice 30, makes it possible to vary the fluid flowrate. In addition, the engagement of the lugs in the windows constitutes axial displacement means, while guaranteeing guidance in turning.

It should also be observed that the rotary actuator element 3 forms a sealing lip 33 in rotary leaktight contact with the sleeve 21. Complete dynamic sealing of the dispenser head is thus guaranteed. In addition, the actuator element 3 also forms an actuator button 34 that assists in turning the element 3. The actuator button 34 is situated over the shelf 26 between the two flanges 24. When the button 34 is in abutment against the flange at the rear, as seen when looking at FIG. 4, the dispenser head is in a slow-flowrate open position. In contrast, when the actuator button 34 is in abutment against the other flange 24, normally situated in the foreground in FIG. 5, the dispenser head is in the fast-flowrate open position.

According to another advantageous characteristic, the rotary actuator element also includes first-use guarantee means in the form of a tab 35 that is made integrally as a single part with the remainder of the actuator element 3, and that is disposed in the indentation 25. The tab 35 preferably extends over the entire width of the indentation 25, so as to come into abutment against both adjacent flanges 24. In this way, the rotary actuator element 3 is prevented from turning in the closed position. This can clearly be seen in FIG. 2 and in FIG. 3. In order to actuate the dispenser head, it is necessary to begin by pulling off the tab 35.

By means of the invention, a dispenser head is obtained having two open positions that are identical, or preferably different, located on each side of a closed position that is intermediate, or even central. Displacement means in the form of the co-operation between lugs and chevron-shaped windows can be compared to a type of screw-engagement having threads that are chevron shaped, with inclination slopes that are identical or different, and with slope lengths that are identical or different.

The invention claimed is:

1. A fluid dispenser head for associating with a fluid reservoir (1), said head comprising: a stationary base (2) formed by, or for mounting on, said reservoir; a rotary actuator element (3) mounted in rotary manner on the base (2) so as to turn about an axis of rotation between two extreme abutment positions; and a dispenser orifice (30) that can be closed selectively by turning the element on the base, the dispenser orifice (30) being situated on the axis of rotation of the element on the base, the two extreme abutment positions defining two open positions of the dispenser orifice separated by at least one position in which the dispenser orifice is closed, the dispenser head comprising axial displacement means (221, 321) for axially displacing the element (3) relative to the base (2) while turning on the base, the axial displacement means comprising at least one guide path (221) presenting two sections (2211, 2212) that are connected together at a low point (2210), each of the two sections defining a respective extreme abutment (2213, 2214), the two extreme abutments respectively corresponding to the two open positions, and the low point corresponding to the closed position, and the two sections having slopes presenting inclinations or lengths that are different so that the two sections are non-symmetrical with respect to the low point.

2. A dispenser head according to claim 1, in which the base forms at least one axial, rotary guide window (221) that extends over a fraction of the periphery of the base, said window defining the guide path, said window forming two connected-together window sections (2211, 2212), a first section defining a first slope, and the second section (2212) defining a second slope that is different from the first slope, each section defining an abutment end (2213, 2214), the abutment ends being offset axially, the actuator element including at least one axial, rotary guide lug (321) engaged in said window, so that while the actuator element is being turned on the base, said at least one lug is displaced in its respective window, thereby displacing the actuator element (3) axially, so as to reach different heights depending on whether the lug is in abutment against the first section or against the second section.

3. A dispenser head according to claim 1, in which the base (2) includes a ring (22) formed with a plurality of axial, rotary guide windows (221) distributed over the periphery of the ring, the element (3) including a skirt (32) that extends around the ring, and that, on its inside, forms a plurality of axial, rotary guide lugs (321) that are engaged in respective windows.

4. A dispenser head according to claim 1, further comprising flowrate-varying means (20) for varying, from one open position to the other, the rate at which the fluid flows through the dispenser orifice.

5. A dispenser head according to claim 1, in which the actuator element (3) forms the dispenser orifice (30), and the base (2) forms a closure pin (20), which, in the closed position, is engaged in the dispenser orifice, and in the open positions, is disengaged from the orifice by different amounts, so that the flowrates through the orifice are different in the two open positions.

6. A dispenser head according to claim 5, in which the actuator element (3) includes axial guide means (36) engaged around the pin (20), so that the pin is slidably mounted in said axial guide means, said guide means extending downwards from the periphery of the dispenser orifice, said guide means forming a plurality of slots (363) of sizes that vary as a function of the position of the pin in the axial guide means.

7. A dispenser head according to claim 6, in which the axial guide means comprise a plurality of tabs (361) that extend downwards from the outer periphery of the dispenser orifice, said tabs being connected together by a scraper (362) that is slidably engaged around the pin.

8. A dispenser head according to claim 5, in which the base (2) includes an inner sleeve (21) inside which the pin (20) extends, the actuator element includes a cover (31, 32) disposed on the sleeve and forming the dispenser orifice (30), said cover including an annular lip (33) in leaktight, rotary sliding contact with said sleeve (21).

9. A dispenser head according to claim 1, in which the actuator element (3) includes a detachable safety tab (35) that is blocked by the base (2), so that, in the closed position, the actuator element is prevented from turning on the base.

10. A dispenser head according to claim 1, in which the two extreme open positions are separated by at least one intermediate, fixed open position.

11. A fluid dispenser head for associating with a fluid reservoir, the head comprising:

a stationary base formed by, or for mounting on, the reservoir;

a rotary actuator element mounted in rotary manner on the base so as to turn about an axis of rotation between two extreme abutment positions;

a dispenser orifice closable by turning the rotary actuator element on the base, the dispenser orifice situated on the axis of rotation of the rotary actuator element on the base, the two extreme abutment positions defining two open positions of the dispenser orifice separated by at least one closed position in which the dispenser orifice is closed; and an opening in the base defining a guide path for a lug on the rotary actuator element so that when the rotary actuator is turned, the rotary actuator is axially displaced relative to the base;

the guide path comprising at least two inclined sections connected by an intermediate section that contains the low point of the guide path, each of the two inclined sections defining a respective one of the two extreme abutment positions, and the low point corresponding to the closed position;

the two inclined sections are non-symmetrical with respect to the low point of the guide path.

12. The dispenser head according to claim 11, wherein the actuator element forms the dispenser orifice, and the base forms a closure pin, which, in the closed position, is engaged in the dispenser orifice, and in the open positions, is disengaged from the orifice by different amounts depending on the position of the lug in the guide path so that the flowrates through the orifice differ.

13. The dispenser head according to claim 12, wherein the actuator element comprises an axial guide engaged around the pin, so that the pin is slidably mounted in the axial guide, the axial extending downwards from a periphery of the dispenser orifice, the axial guide comprising a plurality of slots defining openings that vary as a function of the position of the pin in the axial guide.

14. The dispenser head according to claim 13, wherein the axial guide comprise a plurality of tabs that extend downwards from the outer periphery of the dispenser orifice, the tabs connected together by a scraper that is slidably engaged around the pin.

15. The dispenser head according to claim 12, wherein the base comprises an inner sleeve inside which the pin extends, the actuator element comprises a cover disposed on the sleeve and forming the dispenser orifice, the cover comprising an annular lip in leaktight, rotary sliding contact with the sleeve.

16. The dispenser head according to claim 11, wherein the actuator element comprises a detachable safety tab that is blocked by the base, so that, in the closed position, the actuator element is prevented from turning on the base.

17. The dispenser head according to claim 11, wherein the two inclined sections have slopes presenting inclinations or lengths that are different so that the two inclined sections are non-symmetrical with respect to the low point.

18. The dispenser head according to claim 11, wherein the two inclined sections have slopes presenting inclinations that are different so that one of the two inclined sections slopes differently from the other of the two inclined sections.

19. The dispenser head according to claim 11, wherein the two inclined sections have lengths that are different so that one of the two inclined sections is longer than the other of the two inclined sections.

20. The dispenser head according to claim 11, wherein when the lug abuts one of the two extreme abutment positions the lug is at a height relative to the low point that is greater than a height of the lug relative to the low point when the lug abuts the other of the two extreme abutment positions.

* * * * *